US006311514B1

(12) United States Patent
Chisnell

(10) Patent No.: US 6,311,514 B1
(45) Date of Patent: Nov. 6, 2001

(54) REFRIGERATION ACCUMULATOR HAVING A MATRIX WALL STRUCTURE

(75) Inventor: Jerry H. Chisnell, Northville, MI (US)

(73) Assignee: Automotive Fluid Systems, Inc., Troy, MI (US)

( * ) Notice: Subject to any disclaimer, the term of this patent is extended or adjusted under 35 U.S.C. 154(b) by 0 days.

(21) Appl. No.: 09/544,856

(22) Filed: Apr. 7, 2000

(51) Int. Cl.[7] ..... F25B 43/00
(52) U.S. Cl. ..... 62/503
(58) Field of Search ..... 62/503, 155, 474, 62/498, 467; 96/135, 189; 55/159, 192; 29/890.06

(56) References Cited

U.S. PATENT DOCUMENTS

| | | | | |
|---|---|---|---|---|
| 2,013,193 | | 9/1935 | Stadtfeld . | |
| 2,082,584 | | 6/1937 | Magis . | |
| 2,401,974 | | 6/1946 | Siebels . | |
| 2,468,902 | | 5/1949 | Villiger . | |
| 2,650,112 | | 8/1953 | Kinkead . | |
| 2,894,537 | | 7/1959 | Carr . | |
| 3,082,024 | | 3/1963 | Boylan . | |
| 3,110,754 | | 11/1963 | Witort et al. . | |
| 3,495,628 | | 2/1970 | Boender . | |
| 3,563,053 | | 2/1971 | Bottum . | |
| 3,703,957 | * | 11/1972 | Swanson et al. | 209/31 |
| 3,803,810 | * | 4/1974 | Rosenberg . | |
| 4,008,581 | * | 2/1977 | Hudson, Jr. | 62/503 |
| 4,009,596 | * | 3/1977 | Morse | 62/503 |
| 4,037,626 | | 7/1977 | Roberts, Jr. . | |
| 4,157,194 | | 6/1979 | Takahashi . | |
| 4,208,887 | * | 6/1980 | Morse et al. | 62/503 |
| 4,215,727 | | 8/1980 | ter Wijen . | |
| 4,341,392 | | 7/1982 | van Dongeren . | |
| 4,474,035 | | 10/1984 | Amin et al. . | |
| 4,509,340 | * | 4/1985 | Mullally et al. | 62/503 |
| 4,651,540 | * | 3/1987 | Morse | 62/503 |
| 4,768,355 | | 9/1988 | Breuhan et al. . | |
| 4,929,000 | | 5/1990 | Annestedt, Sr. . | |
| 4,938,036 | | 7/1990 | Hodgkins et al. . | |
| 5,069,255 | | 12/1991 | Muszynski . | |
| 5,125,691 | | 6/1992 | Bogdan . | |
| 5,141,260 | | 8/1992 | Burwell . | |
| 5,177,982 | * | 1/1993 | Plemens | 62/503 |
| 5,374,806 | * | 12/1994 | Chou | 219/229 |
| 5,375,327 | | 12/1994 | Searfoss et al. . | |
| 5,433,252 | | 7/1995 | Wolf et al. . | |
| 5,471,809 | | 12/1995 | Frankel . | |
| 5,471,854 | | 12/1995 | DeNolf . | |
| 5,729,998 | * | 3/1998 | Grohs et al. | 62/474 |
| 5,787,729 | | 8/1998 | Wijaya . | |

* cited by examiner

*Primary Examiner*—Teresa Walberg
*Assistant Examiner*—Daniel Robinson
(74) *Attorney, Agent, or Firm*—VanOphem & VanOphem, P.C.

(57) ABSTRACT

An accumulator includes a housing having an open top end, an open bottom end, an outer wall, and an inner wall disposed within the outer wall to define an interior. The inner and outer walls are integrally interconnected by longitudinal partitions that define longitudinal channels with a downflow channel and an upflow channel positioned among the longitudinal channels. A top cover mounts to, and closes, the open top end of the housing, and has an inlet passage and an outlet passage therethrough. A refrigerant separator is positioned beneath the top cover for directing refrigerant from the inlet passage of the top cover to the interior of the housing, for venting gaseous refrigerant to the downflow passage of the housing while preventing ingress of liquid refrigerant therein, and for communicating gaseous refrigerant from the upflow passage of the housing to the outlet passage of the top cover. A cross-passage conveys gaseous refrigerant from the downflow passage of the housing to the upflow passage of the housing and includes a pickup tube for lubricating the refrigerant flowing through the cross-passage. Liquid refrigerant entering the accumulator collects in the interior of the housing and gaseous refrigerant is conveyed through an aperture in the refrigerant separator down the downflow passage, across the accumulator through the cross-passage, up the upflow passage, over the refrigerant separator, and out the outlet passage of the top cover.

20 Claims, 7 Drawing Sheets

REFRIGERATION ACCUMULATOR HAVING A MATRIX WALL STRUCTURE

BACKGROUND OF THE INVENTION

1. Field of the Invention

The present invention relates to an accumulator device for use In an air-conditioning system, and more particularly to an accumulator device for use in an air-conditioning refrigeration system of a motor vehicle.

2. Description of the Prior Art

The use of accumulator devices in air-conditioning systems, particularly motor vehicle air-conditioning systems, is well known. It is also well known to use steel or aluminum in manufacturing an accumulator housing. However, it is less common to use plastic in manufacturing accumulator housings since environmental and performance requirements require use of prohibitively thick plastic walls.

In a typical air-conditioning system, the compressor receives a gaseous refrigerant from the evaporator and compresses the gaseous refrigerant, sending it under high pressure to the condenser as a superheated vapor. Since the high-pressure vapor delivered to a condenser is much hotter than the surrounding air, the heat of the high-pressure vapor is given off to the outside air flowing through the condenser fins, thereby cooling the refrigerant. As the gaseous refrigerant loses heat to the surrounding air, it condenses into a liquid refrigerant. The condensed liquid refrigerant then enters an orifice tube at which the pressurized liquid refrigerant transforms into a gaseous state thereby absorbing heat from warm air passing through the fins of the evaporator.

After the warmed liquid refrigerant changes phase to gas, it is passed from the evaporator to an accumulator. From the accumulator, the refrigerant is passed back to the compressor to start the cycle over again. However, it is very important to ensure that the refrigerant being passed back to the compressor is in a completely gaseous state. If liquid refrigerant reaches the compressor, it will clog it up. Thus, the accumulator'main purpose is to assure that only gaseous refrigerant passes to the compressor. Additionally, the accumulator injects a prescribed amount of lubricating oil into the gaseous refrigerant for lubricating the compressor. Furthermore, the accumulator can be used to make sure the oil-laden gaseous refrigerant is free of particulates that might also harm the compressor.

Accordingly, the accumulator of an air-conditioning system can be used to accomplish five functions, it (a) completely vaporizes the refrigerant, (b) removes all water vapor, (c) traps all particulates, (d) injects a lubricant into the outgoing refrigerant vapor stream, and (e) acts as a reservoir for the refrigerant when system demand is low. Typical examples of accumulators accomplishing these functions are shown in U.S. Pat. Nos. 3,798,921; 4,111,005; 4,291,548; 4,496,378; 5,052,193; and 5,282,370.

Typically, a suction accumulator consists of a liquid storage vessel in which is received a generally U-shaped tube, one end of which is connected to the outlet of the storage vessel and the other end of which is opened to the interior of the vessel. As the incoming liquid refrigerant flows into the vessel, it collects in the bottom of the interior and the gaseous components of the refrigerant are forced, due to pressure in the accumulator and the vacuum created by the compressor, through the open end of the U-shaped tube and out of the accumulator. Oil for lubricating the compressor collects in the bottom of the vessel along with any liquid refrigerant. Typically, an orifice located in a bight portion of the U-shaped tube entrains, by venturi action, a metered amount of oil into the gaseous refrigerant exiting the accumulator.

A problem with prior art accumulators is that it is necessary to introduce some type of device, such as a refrigerant separator member, to prevent substantial amounts of liquid refrigerant from exiting the accumulator or gaining access to the open end of the U-shaped tube. Thus, it is customary to employ a refrigerant separator member somewhere proximate the open inlet end of the U-shaped tube in order to prevent the liquid from entering the exit tube of the accumulator. Typically, these refrigerant separator members have a frustoconical design that serves to deflect the liquid refrigerant back down into the bottom portion of the accumulator while allowing the gaseous refrigerant to pass by.

An example of such a device includes U.S. Pat. No. 4,474,035 to Amin et al. Amin et al. disclose a domed refrigerant separator located in an upper region of an accumulator housing adjacent an accumulator inlet opening. Liquid refrigerant enters the accumulator housing through the inlet opening in the top of the housing and disperses over the dome of the refrigerant separator toward the sides of the housing. This creates vertical flow of the refrigerant down the sides of the accumulator housing. The vapor component of the refrigerant collects in the upper region of the housing beneath the refrigerant separator, near the inlet end of an outlet tube. Amin et al. disclose that an inlet end of an outlet tube is located directly below the domed refrigerant separator. Amin et al. further disclose that a leg of the outlet tube is brazed or welded in a hole in the refrigerant separator as well as to the top of the accumulator housing.

Accordingly, traditional prior art accumulator references uniformly disclose and teach the use of a refrigerant separator member. The refrigerant separator member prevents liquid refrigerant from reaching an exit tube that is partially located within the accumulator and that is used to convey the gaseous refrigerant it to the compressor. The components, such as the exit tube and the refrigerant separator member, necessary to achieve the stated functions of an accumulator, add significantly to the cost, complexity and potential problems associated with prior art accumulators.

One recent approach to solving Such problems with traditional accumulators is represented in U.S. Pat. No. 5,471,854 to DeNolf. DeNolf teaches use of an accumulator that does not have a refrigerant separator member or tubes within a housing. DeNolf discloses the accumulator as having an inner housing with standoffs disposed within an outer housing thereby defining a flow path therebetwcen. A cap seals the inner and outer housings and connects the accumulator to an air-conditioning system. A refrigerant is introduced to the inner housing and flows through an aperture in the inner housing into and through the flow path down one side of the accumulator, across the bottom of the accumulator, back up an opposite side of the accumulator, and out the accumulator via a passage in the cap.

While the DeNolf reference represents a very significant improvement over the structure of traditional accumulators, it unfortunately involves a few drawbacks. For one, the DeNolf reference involves multiple housings that must be individually formed and further processed. Additionally, a rather rigid material, Such as aluminum, must be used in order to withstand the internal forces due to pressure within the refrigeration system and the external forces imposed upon the accumulator during assembly. Therefore, cheaper and lighter weight materials such as plastic are not generally usable with such a design. Finally, the DeNolf reference does not disclose structure for shielding the aperture in the inner housing from incoming liquid refrigerant.

Thus, there remains a need for an accumulator for use in an air-conditioning system of an automotive vehicle, that is adaptable to plastic materials, is more capable and more reliable in preventing liquid refrigerant from reaching the inlet line of the compressor, and wherein the accumulator does not require the use of an exit tube such as is known in the prior art. The use of plastics and the elimination of the tube and multiple housings of the prior art would result in significant cost savings in the manufacture of the accumulator.

SUMMARY OF THE INVENTION

The present invention contemplates an accumulator design for an air-conditioning system, wherein the accumulator is adaptable to use of plastics, is efficient in its operation, includes a minimum number of parts, and is less expensive to manufacture as compared to known accumulators. To reduce the number of parts and time needed to produce the accumulator, the invention further contemplates an accumulator housing wherein the tubes and multiple housings are not required.

An accumulator includes a housing having an open top end, an outer wall, and an inner wall disposed within the outer wall such that the inner wall defines an interior of the accumulator. The inner and outer walls are integrally interconnected by longitudinal partitions that define longitudinal channels. The longitudinal partitions further define a downflow channel and an upflow channel positioned among the longitudinal channels. The housing also has an interior defined between the open top and bottom ends, inside of the inner wall. A top cover is mounted to the open top end of the housing for closing the open top end of the housing. The top cover has an inlet passage and an outlet passage therethrough. A refrigerant separator is positioned beneath the top cover for directing refrigerant from the inlet passage of the top cover through to the interior of the housing, for preventing liquid refrigerant from entering the downflow passage of the housing, and for communicating gaseous refrigerant from the upflow passage of the housing to the outlet passage of the top cover. The refrigerant separator includes an aperture for venting gaseous refrigerant from the interior of the housing to the downflow passage of the housing. A cross-passage connects the downflow passage of the housing to the upflow passage of the housing, for conveying gaseous refrigerant therebetween. The cross-passage includes a pickup tube for lubricating gaseous refrigerant flowing through the cross-passage. Liquid refrigerant entering the accumulator collects in the interior and is vented through the aperture of the refrigerant separator, down the downflow passage of the housing, across the cross-passage, Lip the upflow passage of the housing, over the refrigerant separator, and out the outlet passage of the top cover.

It is an object of the present invention to provide an accumulator that overcomes some or all of the above-mentioned problems with the prior art.

It is another object to provide an accumulator that is capable of being automatically assembled.

It is yet another object of the present invention to provide an accumulator of the type described above in which a desiccant-containing member can be mounted inside of the housing.

It is a further object of the present invention to provide an accumulator of the type described above that can be made out of a variety of materials.

It is still a further object of the present invention to provide an accumulator of the type described above that can be made out of aluminum or plastic.

It is but a further object of the present invention to provide an accumulator of the type described above that does not incorporate a J-tube located within the housing of the accumulator.

It is yet another object of the present invention to provide an accumulator of the type described above that costs less to manufacture.

The above objects and other objects, features and advantages of the present invention are readily apparent from the following detailed description of the best mode for carrying out the invention when taken in conjunction with the accompanying drawings.

DETAILED DESCRIPTION OF THE PREFERRED EMBODIMENT

In general, and in view of this disclosure, those skilled in the art will appreciate that an accumulator according to the present invention may be used in other types of air-conditioning systems and at various locations within such systems.

Figure 1:
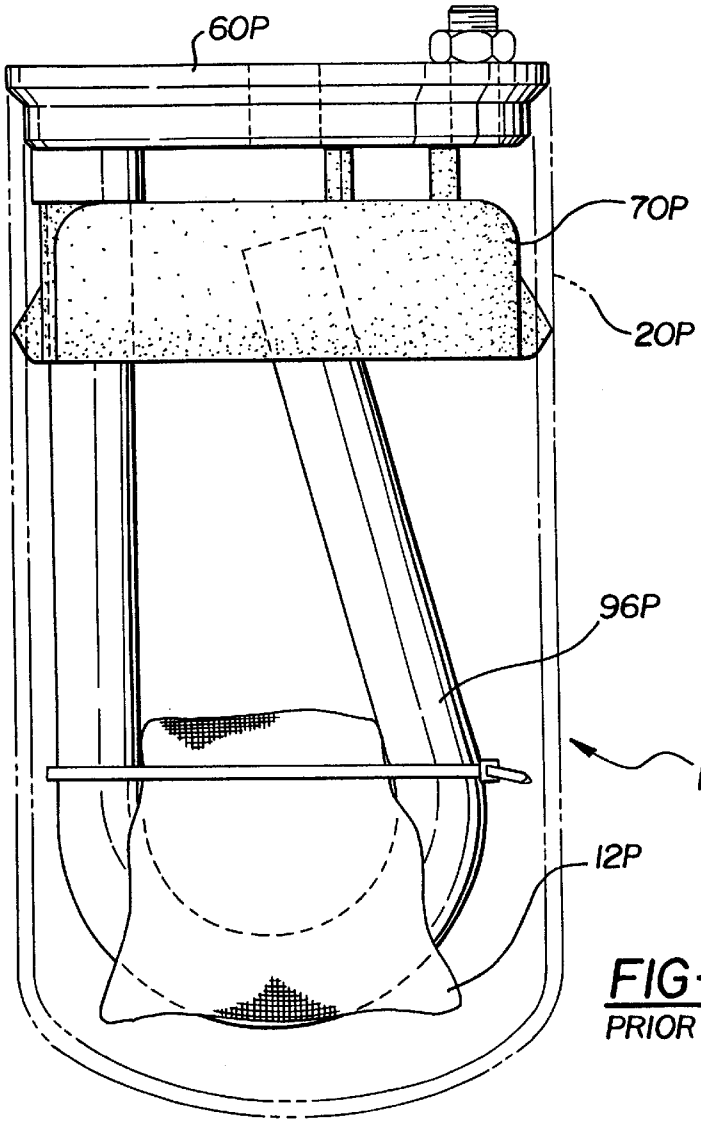
FIG-1 PRIOR ART
FIG. 1 is a front view of a prior art accumulator.

Referring now specifically to the structure of the present invention as shown in the Figures, there is shown in FIG. 1 an aluminum prior art accumulator 10P having a cylindrical housing 20P (shown in phantom line), a top cover 60P, a refrigerant separator 70P, and a J-tube 96P with a desiccant pack 12P strapped thereto. The accumulator 10P is not easily assembled automatically since the J-tube 96P must be bent and positioned in place to the top cover 60P by hand. Additionally, the desiccant pack 12P must be strapped in place to the J-tube 96P by hand.

Figure 2A:
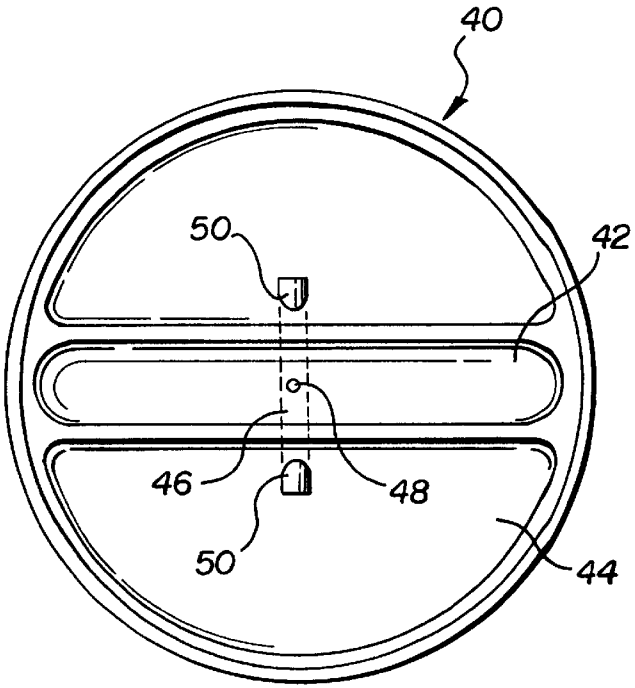
FIG. 2A is a top view of a bottom cover of FIG. 2.
Figure 2:
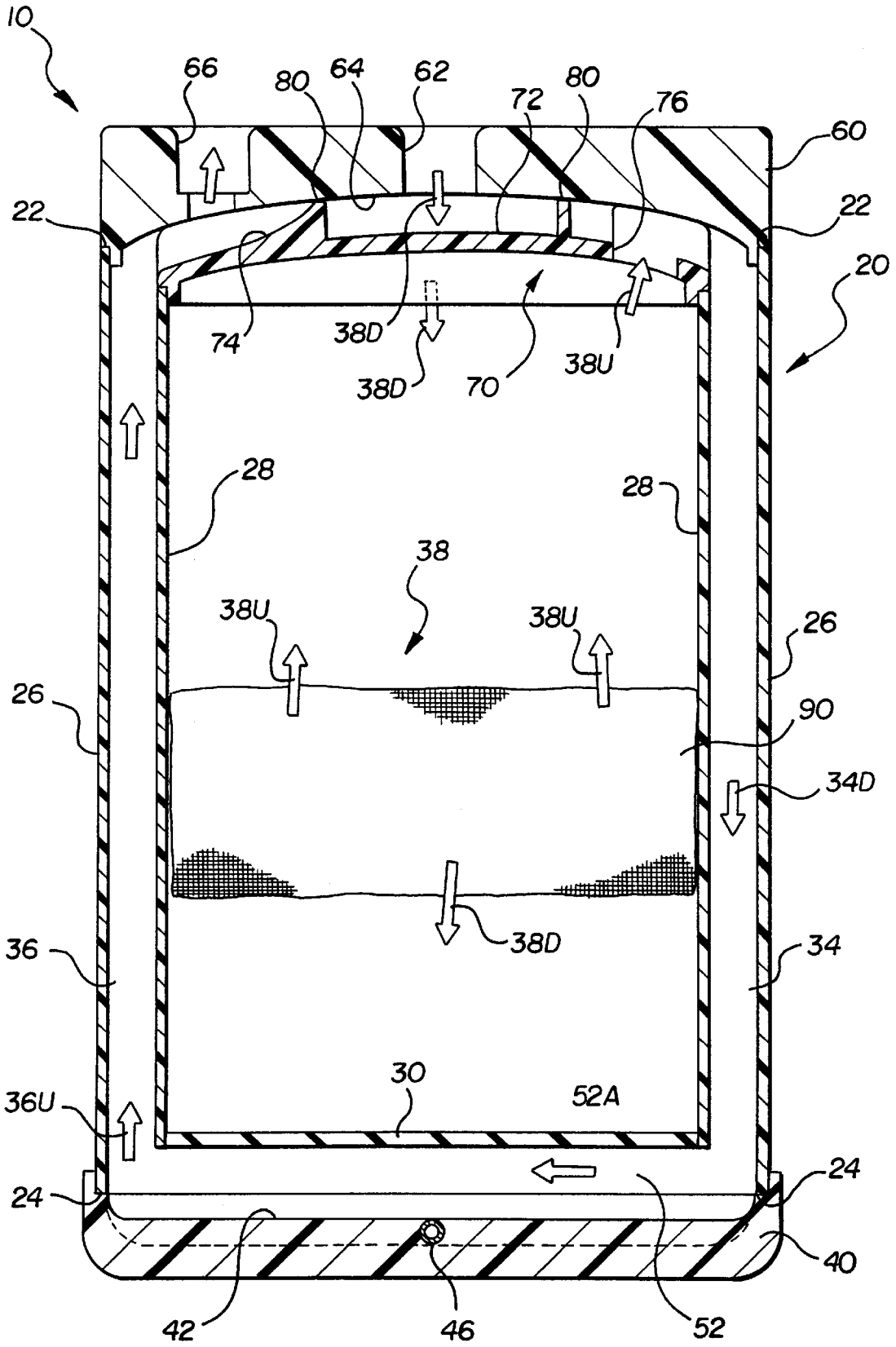
FIG. 2 is a half cross-sectional view of an accumulator according to the preferred embodiment of the present invention.
Figure 10:
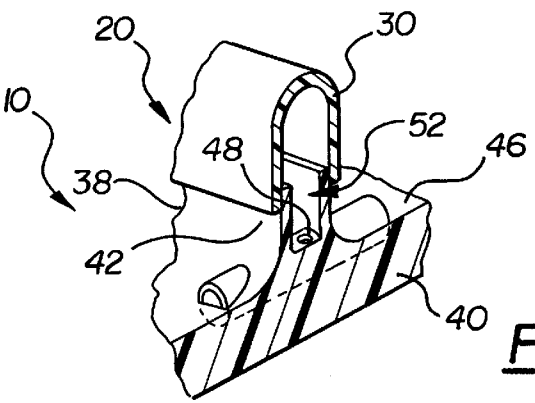
FIG. 10 is a partial cutaway perspective view of the lower portion of the preferred embodiment of the present invention.

As shown in FIG. 2, an accumulator 10 according to the preferred embodiment of the present invention includes a housing 20 preferably in the form of a hollow cylinder and having an open top end 22 and an open bottom end 24. The housing 20 also has an outer wall 26 and an inner wall 28 disposed within the outer wall 26. At the open bottom end 24, a U-shaped canopy 30 spans radially across opposite sides of the inner wall 28. Reference to FIG. 10 will reveal the true shape of the U-shaped canopy 30.

Figure 3:
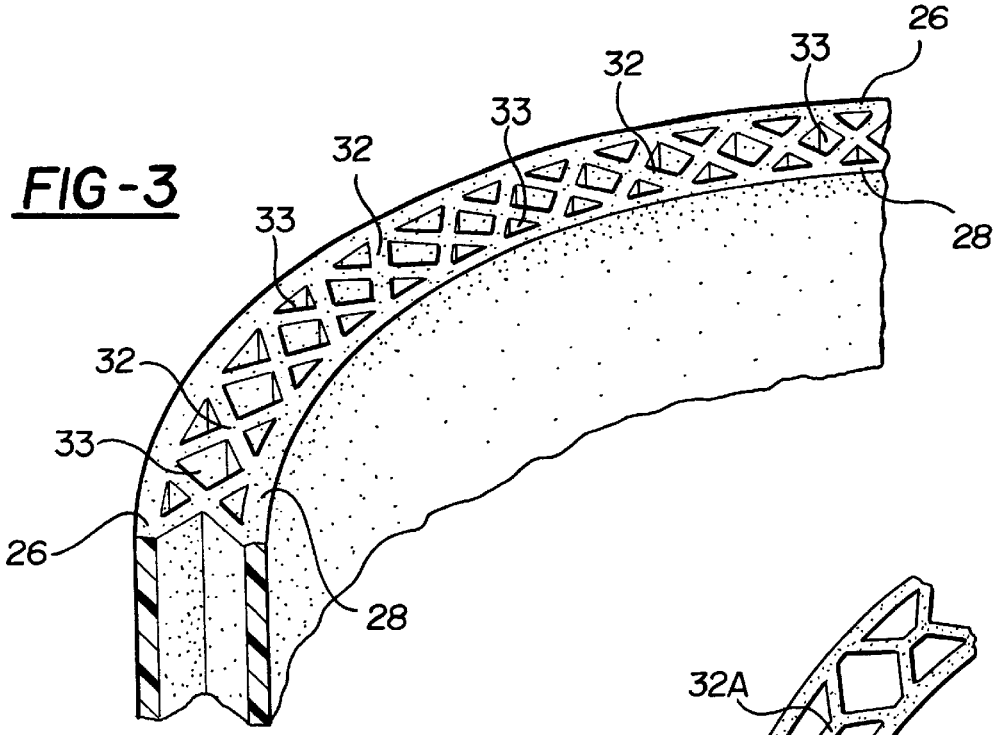
FIG. 3 is partial perspective view of an alternative housing wall, having criss-cross longitudinal partitions.
Figure 3A:
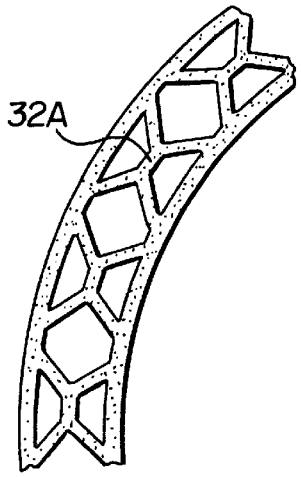
FIG. 3A is a partial top view of an alternative housing wall, having honeycomb longitudinal partitions.
Figure 3B:
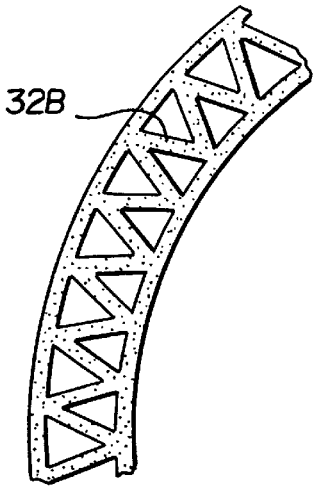
FIG. 3B is a partial top view of a housing wall of FIG. 2, having triangle shaped longitudinal partitions.
Figure 3C:
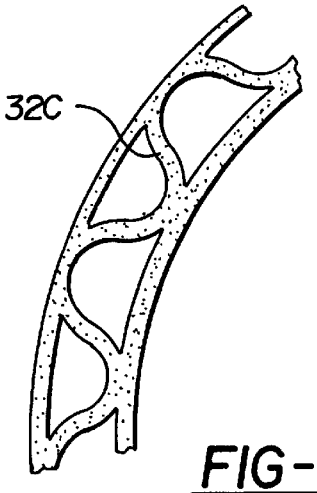
FIG. 3C is a partial top view of an alternative housing wall, having corrugated longitudinal partitions.

As shown in FIG. 3, the inner wall 28 is integrally interconnected to the outer wall 26 by integral longitudinal partitions 32 that define longitudinal passages 33. Such matrix-walled structure is common in the manufacture of plastic well pipe and plastic underground pipelines, as evidenced by U.S. Pat. Nos. 4,215,727 and 4,341,392. Alternatively, integral longitudinal partitions 32A, 32B, 32C may take the form of honeycomb, opposed triangle, or corrugated structure as shown in FIGS. 3A, 3B, and 3C respectively. It is contemplated that other easily formed structures could be substituted for the examples shown in FIGS. 3 through 3C.

Referring again to FIG. 2, the inner and outer walls 28 and 26 extend longitudinally between the open top and bottom ends 22 and 24. In addition, a downflow passage 34 and an upflow passage 36 are disposed between the inner and outer walls 28 and 26. It is possible to construct the housing 20 out of any material suitable for use as an accumulator device of an air-conditioning system, such as ferrous and non-ferrous metals or composites. The housing 20 according to the present invention, however, is preferably manufactured from a polymeric material having sufficient strength to withstand the forces experienced during operation. The housing 20 may be manufactured using any known method but is preferably extruded, injection molded, or made by a combination of the two. Accordingly, the U-shaped canopy 30 may be overmolded separately into an extrusion to form the housing 20. In other words, an extruded portion of the housing 20 may be cut to length from a continuous extrusion and be placed in a molding press where the U-shaped canopy 30 is then molded in position to bottom of the housing 20, as is known in the art of plastics molding.

Still referring to FIG. 2, a bottom cover 40 is preferably molded from plastic and is used to close the open bottom end 24 of the housing 20. The bottom cover 40 includes a pickup tube 46 molded therein. As shown in FIG. 2A, the bottom cover 40 includes an integral U-shaped trough 42 that is molded radially across the bottom cover 40. The pickup tube 46 is mounted transverse to and through the U-shaped trough 42. The pickup tube 46 has a hole 48 that communicates with the inside of the U-shaped trough 42, and further has opposite open ends 50 that communicate with the hole 48. Each opposite open end 50 of the pickup tube 46 opens into separate reservoirs 44 of the bottom cover 40. The U-shaped trough 42 sealingly fits within the U-shaped canopy 30 of the housing 20 to form a cross-passage 52.

The cross-passage 52, as shown in FIG. 2, communicates the downflow passage 34 with the upflow passage 36. Also shown in FIG. 10, the bottom cover 40 includes the U-shaped trough 42 that fits within the U-shaped canopy 30 of the housing 20 to produce a refrigerant-tight seal and define the cross-passage 52. It is possible to connect the U-shaped trough 42 and the U-shaped canopy 30 in any manner as long as the cross-passage 52 thus formed functions to convey gaseous refrigerant across the accumulator 10 between the bottom cover 40 and housing 20, while preventing liquid refrigerant from entering the cross-passage 52. In view of this disclosure, those skilled in the art will appreciate that the bottom cover 40 could be threaded to the housing 20, or snapped to the housing 20 with integral fasteners. Preferably, however, the bottom cover 40 is bonded or ultrasonically welded to the housing 20.

Figure 4:
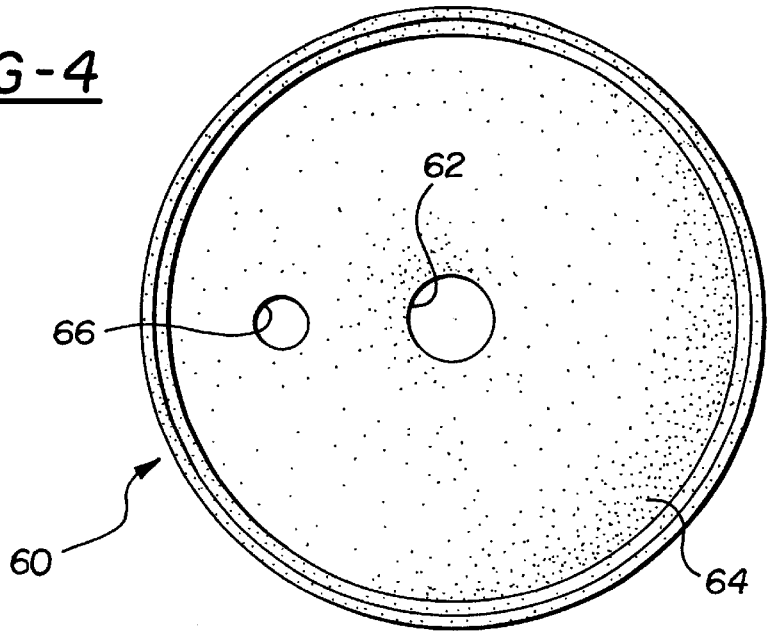
FIG. 4 is a bottom view of a top cover of the accumulator of FIG. 2.

Referring again to FIG. 2, a top cover 60 closes the open top end 22 of the housing 20 and a refrigerant separator 70 is mounted therebetween. An interior 38 of the accumulator 10, having a circular cross section, is defined inside the inner, wall 28 between the top and bottom covers 60 and 40, and beneath the refrigerant separator 70. The top cover 60 includes an inlet passage 62 for introducing refrigerant to an inlet portion 72 of the refrigerant separator 70 and into the interior 38 of the accumulator 10. As shown in FIG. 4, the top cover 60 includes an arcuate undersurface 64 and has an outlet passage 66 positioned next to the inlet passage 62. Referring again to FIG. 2, the outlet passage 66 communicates with the upflow passage 36 via a path defined between a gas outlet portion 74 of the refrigerant separator 70 and the top cover 60. In view of this disclosure, those skilled in the art will appreciate that the top cover 60 could be snapped to the housing 20 with integral fasteners, or could be ultrasonically welded to the housing 20. Preferably, however, the top cover 60 is threaded to the housing 20, to allow the accumulator 10 to be readily serviceable.

Figure 5:
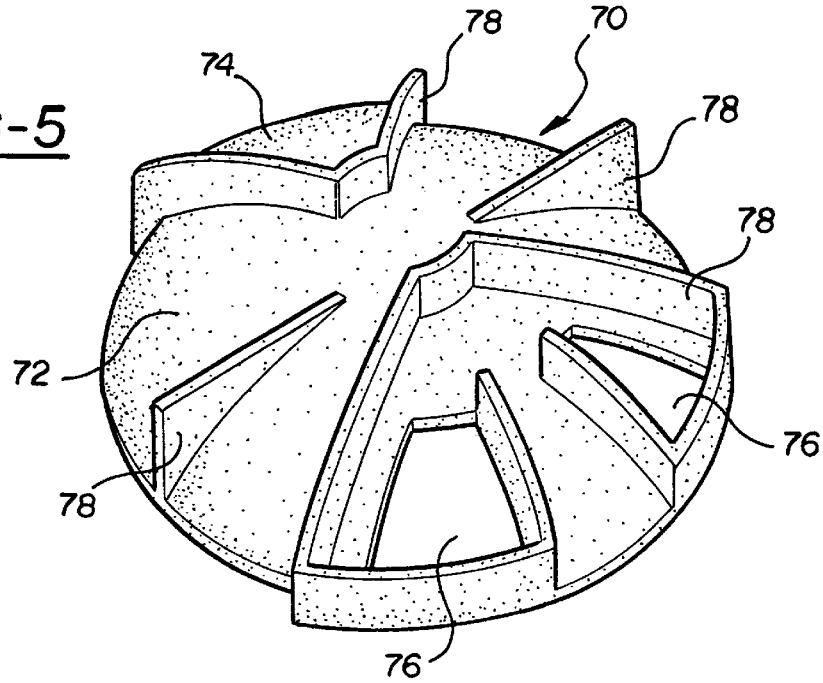
FIG. 5 is a perspective view of a refrigerant separator of the accumulator of FIG. 2.

As shown in FIG. 5, the refrigerant separator 70 is preferably molded from plastic, is convex in shape, and promotes separation of the refrigerant entering the accumulator 10 into separate liquid and gaseous components. The refrigerant separator 70 includes the liquid inlet portion 72, a gas aperture portion 76, and the gas outlet portion 74, that are all separated from one another by partitions 78. As shown in FIG. 2, a top surface 80 of the partitions 78 seals against the arcuate undersurface 64 of the top cover 60 so as to fluidly isolate the inlet portion 72, gas aperture portion 76, and gas outlet portion 74.

Still referring to FIG. 2, a desiccant pack 90 of any known shape and size is inserted in the interior 38 of the housing 20. The desiccant pack 90 is provided to help remove any moisture from the refrigerant that may be harmful to the compressor. Preferably, the desiccant pack 90 is a puck-shaped member that is easily inserted into the interior 38 of the housing 20. In view of this disclosure, those skilled in the art will appreciate that the desiccant contained within the accumulator 10 could include either a pellet or a porous cake form of desiccant, or any other type of desiccant suitable for use in an accumulator device. Preferably, the desiccant pack 90 is positioned within the housing 20 above the ambient liquid refrigerant level. This will assure that the desiccant will be more efficiently used, as it will not be submerged within the liquid refrigerant and lubricating oil. Any known method of positioning the desiccant pack 90 within the housing 20 may be used, such as an interference fit as shown in FIG. 2, or using suitable locating features.

Figure 7:
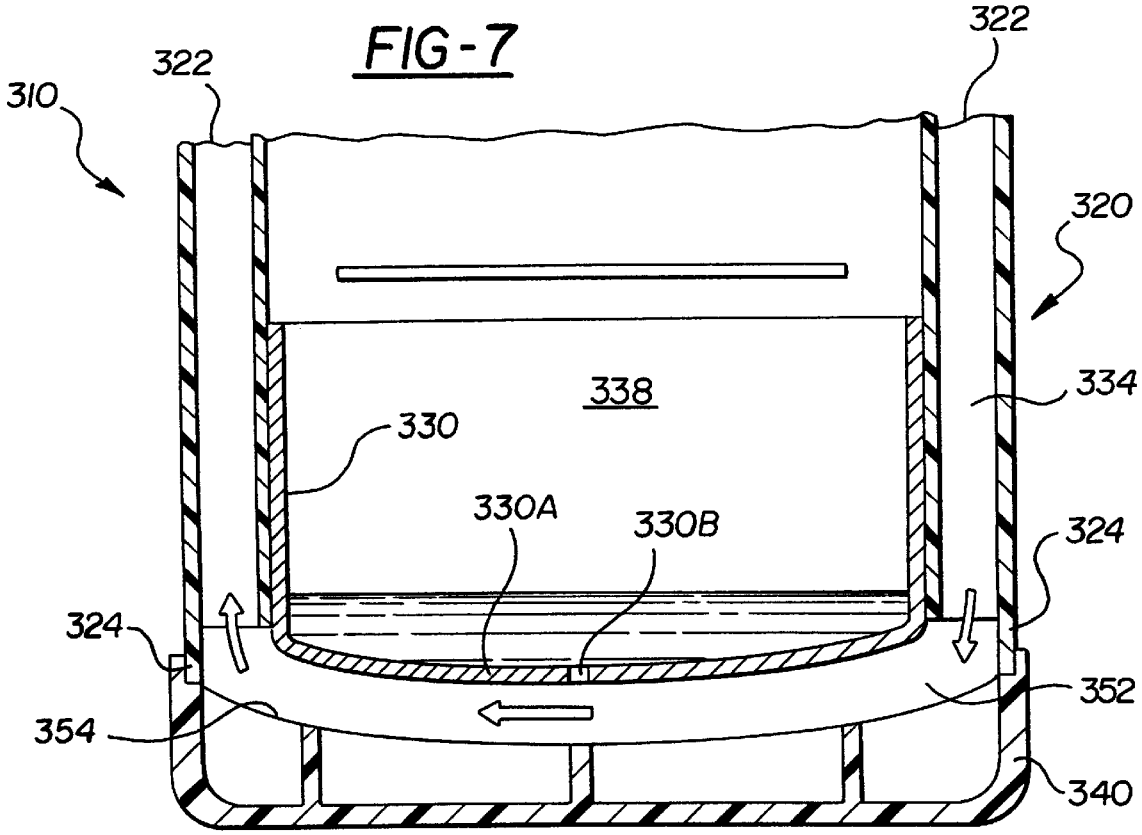
FIG. 7 is a partial cross-sectional view of a lower portion of an accumulator according to an alternative embodiment of the present invention.

An accumulator 310 according to an alternative embodiment of the present invention is shown in FIG. 7. Here, the gaseous refrigerant flows from a downflow passage 334 of a housing 320 into a cross-passage 352 that is defined by a bottom surface 330A of a cup 330 and an upper surface 354 of a bottom cover 340. The cup 330 is preferably molded from plastic and is pressed into an interior 338 of the housing 320 to form a fluid-tight fit with the housing 320. A hole 330B is formed into the bottom surface 330A of the cup 330 to allow oil to be metered into the crosspassage 352.

A method of manufacturing the accumulator 310 according to the alternative embodiment of FIG. 7 involves the following steps. The housing 320, having the top end 322 and bottom end 324, is preferably parted from a continuous extrusion having a matrix cross section as described previously. The top cover (not shown), refrigerant separator (not shown), cup 330, and bottom cover 340 are molded, preferably using an injection molding process. The bottom cover 340 is then secured to the bottom end 324 of the housing 320. The cup 330 is pressed into the top end 322 of the housing 320 and is located inside of the housing 320 until it bottoms out against the bottom cover 340. The desiccant pack (not shown) is provided and assembled into the housing 320. The refrigerant separator (not shown) is installed to the top end 322 of the housing 320 and the top cover (not shown) is fastened to the top end 322 of the housing 320 over the refrigerant separator.

A method of manufacturing the accumulator 10 according to the preferred embodiment of FIG. 2 involves the following steps. Molding the housing 20 having the top end 22 and bottom end 24, and similarly molding the top cover 60, refrigerant separator 70, and bottom cover 40. The bottom cover 40 is secured to the bottom end 24 of the housing 20. A desiccant pack 90 is provided and is assembled into the housing 20. The refrigerant separator 70 is installed to the top end 22 of the housing 20, and the top cover 40 is fastened to the top end 22 of the housing 20.

Figure 2B:
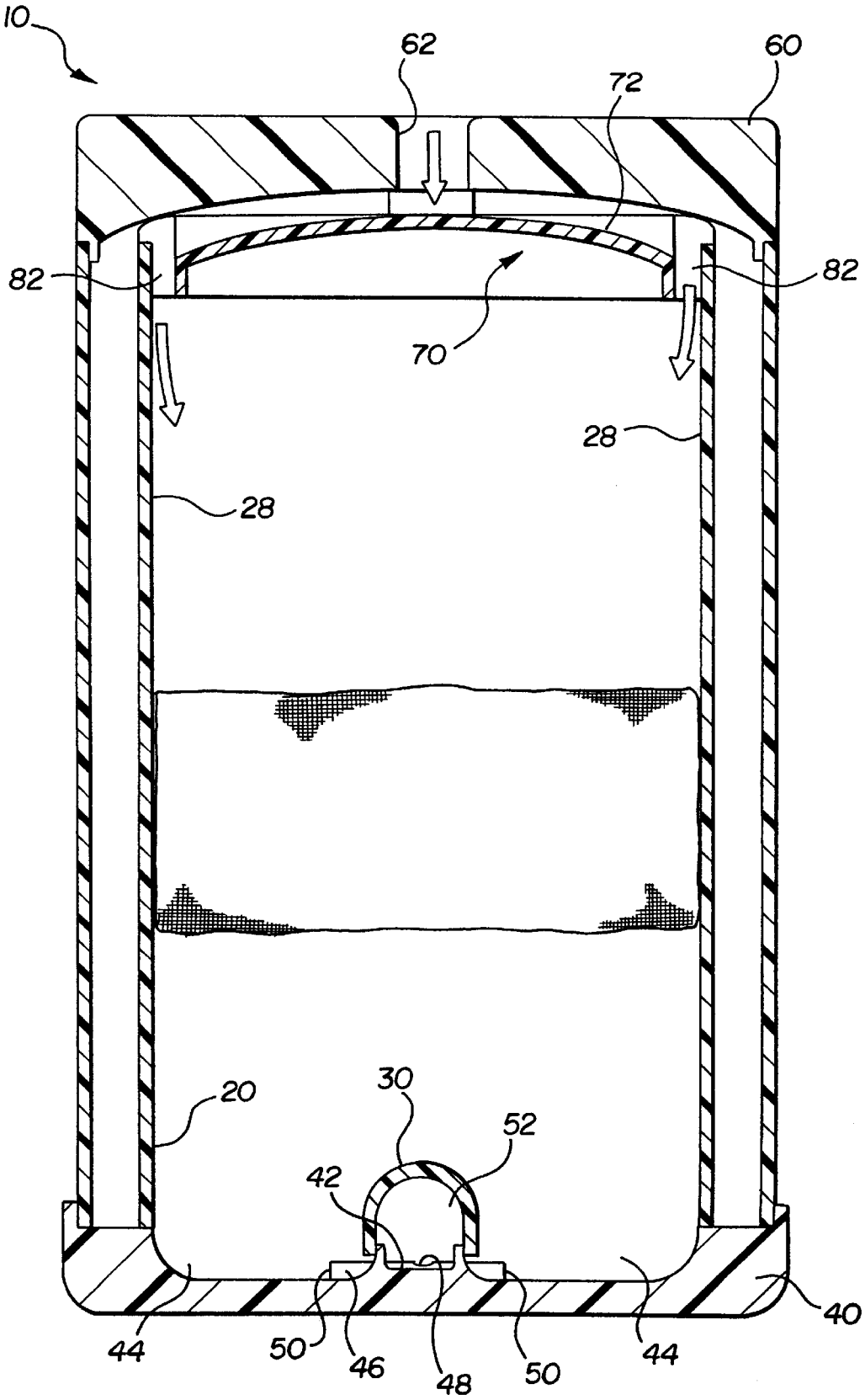
FIG. 2B is another half cross-sectional view of the accumulator of FIG. 2, taken 90 degrees to the cross-section thereof.
Figure 6:
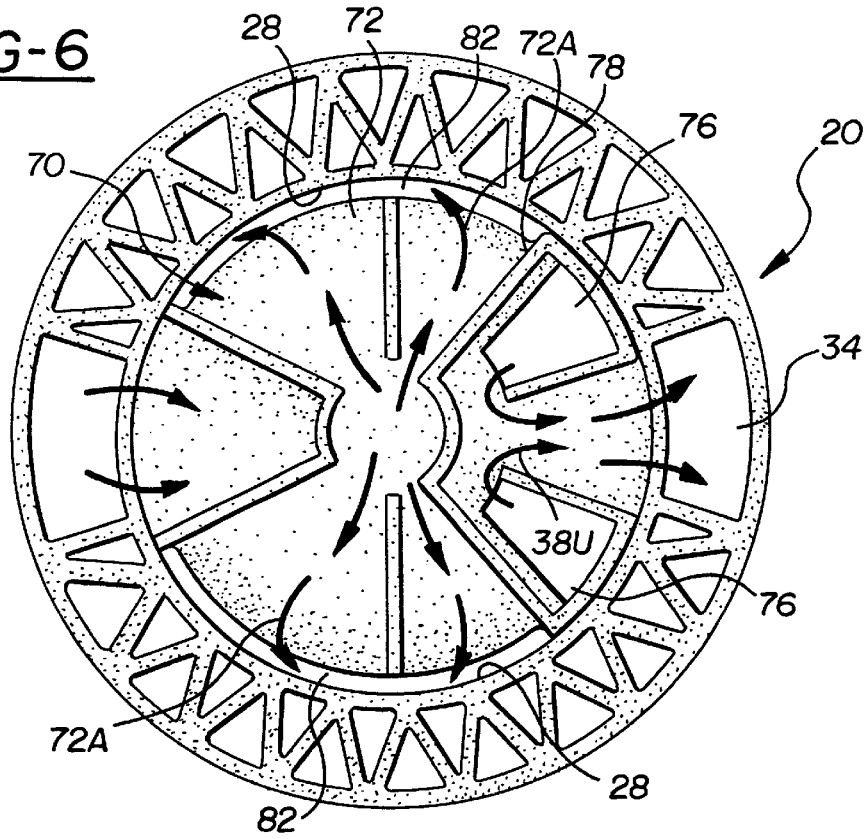
FIG. 6 is a top view of the housing and refrigerant separator of FIG. 2, with the top cover removed.

Referring now to the operation of the present invention and specifically to FIG. 2B, the accumulator 10 performs as follows. Liquid refrigerant enters the accumulator 10 through the inlet passage 62 of the top cover 60 and flows over the liquid inlet portion 72 of the refrigerant separator 70. Arrows 72A in FIG. 6 indicate the flow path of the refrigerant over the liquid inlet portion 72 of the refrigerant separator 70. As indicated in FIGS. 2B and 6, the refrigerant impinges upon the liquid inlet portion 72 and flows radially outward until it reaches a gap 82 defined between the periphery of the liquid inlet portion 72 and the inner wall 28 of the housing 20. At that point the refrigerant flows downward into the housing 20.

Referring again to FIG. 2, the refrigerant flows down into the interior 38 of the housing 20 and through the desiccant pack 90, as indicated by arrows 38D. to The desiccant pack 90 thereby removes moisture from the liquid refrigerant to protect the compressor. Thus, the gaseous refrigerant is collected in the interior 38 of the accumulator 10 and is forced, under pressure resident in the air-conditioning system, to flow through the gas aperture portion 76 of the refrigerant separator 70, as indicated by arrows 38U. The gascous refrigerant is forced to flow into and down the downflow passage 34 of the housing 20, as indicated by arrow 34D. FIG. 6 illustrates the gaseous refrigerant, as indicated by the arrows 38U, flowing up through the gas aperture portion 76 outwardly across the refrigerant separator 70 and down into the downflow passage 34 of the housing 20. The partition 78 separates the gas aperture portion 76 from the inlet portion 72.

Referring again to FIG. 2, the refrigerant flows from the downflow passage 34 into the cross-passage 52, as indicated by arrow 52A. As shown in partial cross-sectional view in FIG. 10, the U-shaped trough 42 of the bottom cover 40 fits into the U-shaped canopy 30 of the housing 20 to define the cross-passage 52. The cross-passage 52 is isolated from the rest of the interior 38 of the accumulator 10 except via the hole 48 in the pick-up tube 46. Oil resident in the refrigerant flowing through the air-conditioning system will collect in the bottom of the accumulator 10. Vacuum is pulled through the pick-up tube 46 as gaseous refrigerant flows through the cross-passage 52 and past the pick-up tube 46. This induces the oil that is resident at the bottom of the interior 38 of the housing 20 to be metered to the center of the pickup tube 46 through the open ends 50 of the pick-up tube and out the hole 48 into the gaseous refrigerant. A metered amount of oil is pulled through the pickup tube 46 so that a controlled amount of oil is returned to the gaseous circuit of the air-conditioning system. This oil helps to keep the compressor lubricated to ensure proper working order.

Figure 9:
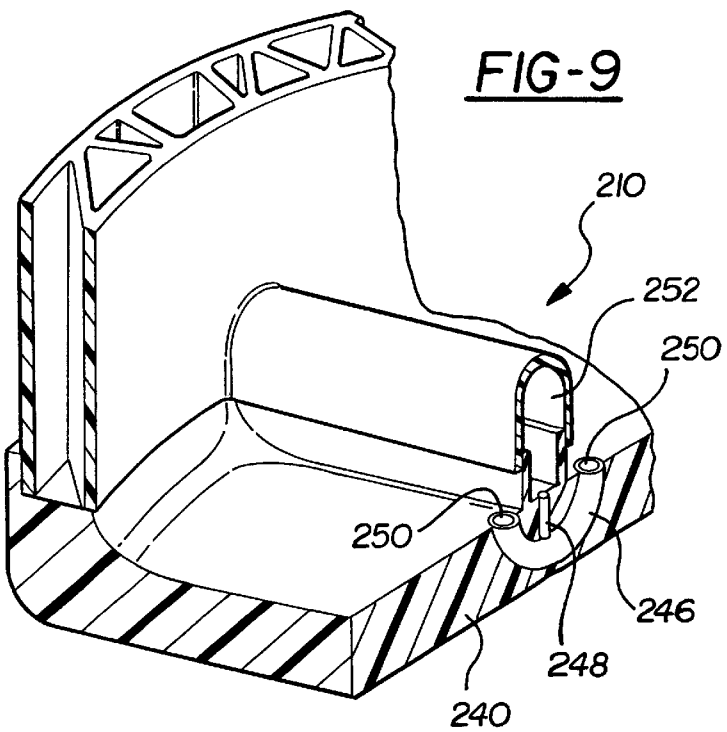
FIG. 9 is a partial cutaway perspective view of the lower portion of another alternative embodiment of the present invention.
Figure 8:
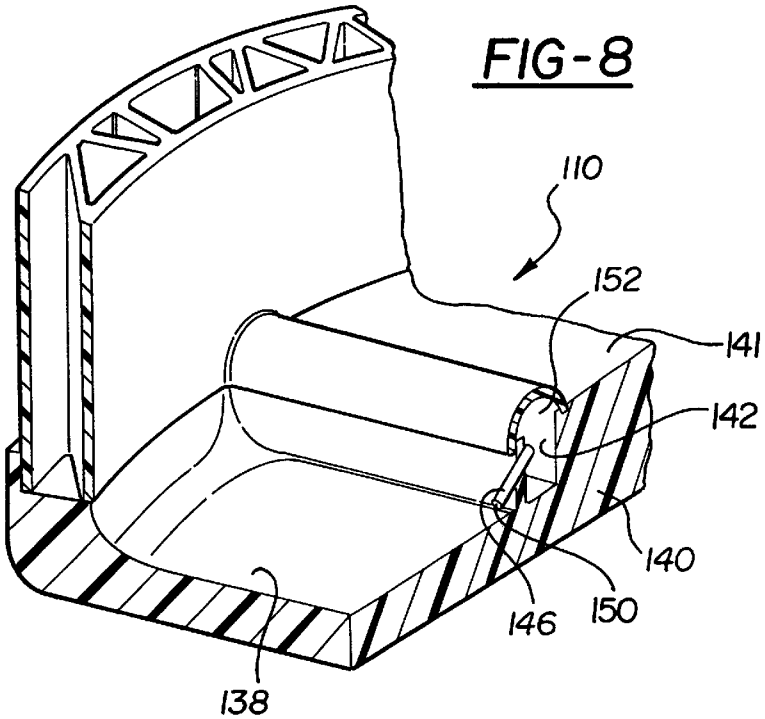
FIG. 8 is a partial cutaway perspective view of the lower portion of an accumulator according to another alternative embodiment.
Figure 8A:
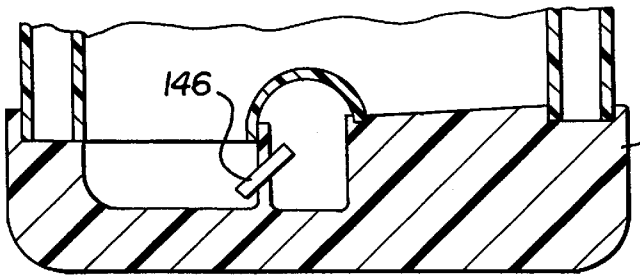
FIG. 8A is right side cross-sectional view of the accumulator of FIG. 8.

FIGS. 8, 8A, and 9 illustrate alternative embodiments of pick-up tubes 146 and 246 mounted within a bottom cover 140 and 240, respectively. FIG. 8 shows a partial view of an accumulator 110 having a pick-up tube 146 molded into a U-shaped trough 142 of the bottom cover 140 so as to communicate a cross-passage 152 with an interior 138 of the accumulator 110. The bottom cover 140 includes a raised and sloped surface 141 for draining oil to the side of the accumulator 110 where the pick-up tube 146 is located. The pick-up tube is located to position an open end 150 at the bottom of the inside of the accumulator 110 where the lubricant settles out of the refrigerant. FIG. 9 illustrates a partial view of an accumulator 210 having a macaroni-shaped pick-up tube 246 having open ends 250 that communicate with an integral stem portion 248 that communicates with a cross-passage 252.

Referring again to FIG. 2, the gaseous refrigerant flows from the cross-passage 52 into and up the upflow passage 36, as indicated by arrow 36U. Finally, the gaseous refrigerant exits the accumulator 10 by flowing from the upflow passage 36, across the outlet portion 74 of the refrigerant separator 70 and out the outlet passage 66 of the top cover 60.

From the above, it can be appreciated that a significant advantage of the present invention is that an accumulator can be manufactured from lightweight, inexpensive plastic components that may be automatically assembled in order to reduce weight and cost.

Another advantage is that in one alternative embodiment the housing may be extruded for purposes of significant cost savings.

Yet another advantage is that the accumulator components may have integral features such as threads and other fastening devices molded integrally therein without any need for machining.

Still another advantage is that the accumulator is rebuildable, involving removal of the top cover followed by removal of the spent or contaminated desiccant pack, followed by cleaning of the interior, followed by insertion of a new desiccant pack, and fastening of the top cover back on the housing.

An additional advantage is that the matrix wall structure of the housing lends itself to improved strength characteristics and improved insulating properties of the accumulator for better overall system efficiency.

While the present invention has been described in terms of a preferred embodiment, it is apparent that other forms could be adopted by one skilled in the art. The accumulator according to the present invention allows for significant changes in the dimensions of the accumulator such that it is possible to have accumulators of different dimensions, shapes, and sizes utilizing the invention described herein. Additionally, it should be obvious that the exterior structure can be modified by one skilled in the art without departing from the invention as disclosed herein. Moreover, a closed bottom housing could be used, and the refrigerant separator could be made integral with the top cover for reduced part count. It would also be possible to reverse the structure of the accumulator to achieve the same flow path described herein. Accordingly, the scope of the present invention is to be limited only by the following claims.

What is claimed is:

1. An accumulator comprising:

a housing having an open top end, an outer wall, and an inner wall disposed within said outer wall, said inner and outer walls being integrally interconnected by a plurality of longitudinal partitions defining a plurality of longitudinal channels, said plurality of longitudinal partitions further defining a downflow passage and an upflow passage positioned among said plurality of longitudinal channels, said housing further having an interior defined inside of said inner wall;

a top cover mounted to said open top end of said housing for closing said open top end of said housing, said top cover having an inlet passage and an outlet passage therethrough;

directing means positioned beneath said top cover for directing refrigerant from said inlet passage of said top cover through to said interior of said housing, said directing means preventing liquid refrigerant from entering said downflow passage of said housing and communicating gaseous refrigerant from said upflow passage of said housing to said outlet passage of said top cover;

venting means positioned beneath said top cover for venting gaseous refrigerant from said interior of said housing to said downflow passage of said housing; and conveying means interposed said downflow passage and said upflow passage of said housing for conveying gaseous refrigerant from said downflow passage of said housing across said accumulator to said upflow passage of said housing, said conveying means including pickup means for lubricating gaseous refrigerant flowing through said conveying means;

whereby refrigerant entering said accumulator collects in said interior of said housing and is conveyed through said venting means, down said downflow passage of said housing, across said conveying means, up said upflow passage of said housing, over said directing means, and out said outlet passage of said top cover.

2. The accumulator as claimed in claim 1, wherein said plurality of longitudinal partitions comprises a honeycomb matrix structure.

3. The accumulator as claimed in claim 1, wherein said plurality of longitudinal partitions comprises a criss-cross matrix structure.

4. The accumulator as claimed in claim 1, wherein said plurality of longitudinal partitions comprises a corrugated matrix structure.

5. The accumulator as claimed in claim 1, further comprising:

a desiccant member disposed within said interior of said housing.

6. The accumulator as claimed in claim 1, wherein said directing means comprises a refrigerant separator separate from said top cover.

7. The accumulator as claimed in claim 1, further comprising a bottom cover mounted to said housing, said bottom cover having a trough portion thereacross.

8. The accumulator as claimed in claim 7, wherein said housing further includes a canopy portion molded thereacross.

9. The accumulator as claimed in claim 8, wherein said conveying means comprises said trough portion of said bottom cover fluid-tightly interlocked within said canopy portion of said housing.

10. An accumulator for a refrigeration system, said accumulator comprising:

a housing having an open top end and an open bottom end opposite said open top end, said housing further having an outer wall and an inner wall disposed within said outer wall, said inner and outlet walls extending longitudinally between said open top and bottom ends, said inner and outer walls being integrally interconnected by a plurality of longitudinal partitions, said plurality of longitudinal partitions defining a plurality of longitudinal channels extending between said open top and bottom ends, said plurality of longitudinal partitions further defining a downflow channel and an upflow channel positioned among said plurality of longitudinal channels, said housing further having an interior defined inside of said inner wall;

a top cover mounted to said open top end of said housing for closing said open top end of said housing, said top cover having an inlet passage and an outlet passage therethrough;

a refrigerant separator positioned between said top cover and said housing, said refrigerant separator including refrigerant receiving means for directing refrigerant from said inlet passage of said top cover through to said interior of said housing, said refrigerant separator further including gas outlet means for communicating gaseous refrigerant from said upflow channel of said housing to said outlet passage of said top cover;

venting means positioned beneath said top cover for venting gaseous refrigerant from said interior of said housing to said downflow channel of said housing; and a bottom cover mounted to said open bottom end of said housing for closing said open bottom end of said housing, said bottom cover including conveying means for conveying gaseous refrigerant from said downflow channel of said housing across said accumulator to said upflow channel of said housing, said bottom cover further including pickup means for lubricating gaseous refrigerant flowing through said conveying means;

whereby refrigerant entering said accumulator collects in said interior of said housing and gaseous refrigerant is vented through said venting means, down said downflow channel of said housing, across said conveying means of said bottom cover, LIP said upflow channel of said housing, over said gas outlet means of said refrigerant separator, and out said outlet passage of said top cover.

11. The accumulator as claimed in claim 10, wherein said plurality of longitudinal partitions comprises a honeycomb matrix structure.

12. The accumulator as claimed in claim 10, wherein said plurality of longitudinal partitions comprises a crisscross matrix structure.

13. The accumulator as claimed in claim 10, wherein said plurality of longitudinal partitions comprises a corrugated matrix structure.

14. The accumulator as claimed in claim 10, further comprising a cup pressed into said interior of said housing and having a bottom surface located against said bottom cover.

15. The accumulator as claimed in claim 14, wherein said conveying means of said bottom cover comprises a trough portion scaled against said bottom surface of said cup to seal said conveying means.

16. A plastic accumulator for use in an automotive air-conditioning system, said plastic accumulator comprising:

a housing having an open top end and an open bottom end opposite said open top end, said housing further having an outer wall and an inner wall disposed within said outer wall, said inner and outer walls extending longitudinally between said open top and bottom ends, said inner and outer walls being integrally interconnected by a plurality of longitudinal partitions, said plurality of longitudinal partitions defining a plurality of longitudinal channels extending between said open top and bottom ends, said plurality of longitudinal partitions further defining a downflow channel and an upflow channel positioned among said plurality of longitudinal channels, said housing further having an interior defined inside of said inner wall, said housing further having a canopy molded across the bottom of said housing for conveying gaseous refrigerant thereacross;

a top cover mounted to said open top end of said housing for closing said open top end of said housing, said top cover having an inlet passage and an outlet passage each positioned longitudinally therethrough;

a refrigerant separator mounted between said top cover and said open top end of said housing, said refrigerant separator including a refrigerant inlet portion for directing incoming refrigerant from said inlet passage of said top cover through to said interior of said housing, said refrigerant separator further including a gas aperture portion for venting gaseous refrigerant from said interior of said housing into said downflow channel of said housing, said refrigerant separator further including a gas outlet portion for communicating lubricated gaseous refrigerant from said upflow channel of said housing to said outlet passage of said top cover; and a bottom cover mounted to said open bottom end of said housing for closing said open bottom end of said housing, said bottom cover including, a trough interlocking with said canopy of said housing to define a cross-passage for conveying gaseous refrigerant from said downflow channel of said housing to said upflow channel of said housing, said bottom cover further including pickup means for lubricating gaseous refrigerant flowing through said trough;

whereby refrigerant enters said inlet passage of said top cover and flows down said refrigerant inlet portion of said refrigerant separator, separates into liquid and gaseous refrigerant, and collects in said interior of said housing, such that gaseous refrigerant rises within said interior and is vented through said gas aperture portion of said refrigerant separator into and down said downflow channel of said housing into said cross-passage, said gaseous refrigerant being lubricated by oil resident in said liquid refrigerant through said pickup means of said bottom cover and flowing into and up said upflow channel of said housing, over said gas outlet portion of said refrigerant separator, and out said outlet passage of said top cover.

17. A method for manufacturing an accumulator of a refrigeration system, said method comprising the steps of:

molding a matrix-walled housing having a top end and a bottom end;

molding a top cover, a refrigerant separator, and a bottom cover;

providing a desiccant pack;

securing said bottom cover to said bottom end of said housing;

assembling said desiccant pack into said matrix-walled housing;

installing said refrigerant separator to said top end of said matrix-walled housing; and fastening said top cover to said top end of said matrix-walled housing.

18. A method of manufacturing an accumulator for a refrigeration system, said method comprising the steps of:

extruding a matrix-walled cylinder;

parting said matrix-walled cylinder into a matrix-walled housing having a top end and a bottom end;

molding a top cover, a refrigerant separator, a cup, and a bottom cover;

providing a desiccant pack;

securing said bottom cover to said bottom end of said matrixwalled housing;

pressing said cup into said top end of said matrix-walled housing and locating said cup inside of said housing against said bottom cover;

assembling said desiccant pack into said matrix-walled housing;

installing said refrigerant separator to said top end of said matrix-walled housing; and fastening said top cover to said top end of said housing.

19. An accumulator for a refrigerant system comprising a dual-walled housing that defines therebetween a plurality of upward and downward flow passages of refrigerant and a conveying means interposed said downward flow passage and said upward flow passage of said housing for conveying gaseous refrigerant from said downward flow passage of said housing across said accumulator to said upward flow passage of said housing, said conveying means including a pickup means for lubricating said gaseous refrigerant flowing through said conveying means.

20. An accumulator comprising:

a housing having an outer wall and an inner wall disposed within said outer wall, said inner and outer walls defining a downflow passage and an upflow passage;

conveying means interposed said downflow passage and said upflow passage of said housing for conveying gaseous refrigerant from said downflow passage of said housing across said accumulator to said upflow passage of said housing, said conveying means including pickup means for lubricating gaseous refrigerant flowing through said conveying means;

whereby refrigerant is conveyed down said downflow passage of said housing, across said conveying means, and up said upflow passage of said housing.

* * * * *

UNITED STATES PATENT AND TRADEMARK OFFICE

CERTIFICATE OF CORRECTION

PATENT NO. : 6,311,514 B1
DATED : November 6, 2001
INVENTOR(S) : Jerry H. Chisnell It is certified that error appears in the above-identified patent and that said Letters Patent is hereby corrected as shown below:

Column 1,
Line 39, delete “accumulator” and insert -- accumulator’s --.

Column 2,
Line 38, after “refrigerant”, delete “it”.
Lines 43 and 62, delete “Such” and insert -- such --.
Line 49, delete “betwcen” and insert -- between --.

Column 3,
Line 52, delete “Lip” and insert -- up --.

Column 6,
Line 18, after “inner” delete a comma “,”.

Column 7,
Line 10, delete “cross section” and insert -- cross-section --.
Line 49, after “38D.” delete “to”.
Line 56, delete “gascous” and insert -- gaseous --.

Column 8,
Line 10, delete “pickup” and insert -- pick-up --.
Line 13, delete “pickup” and insert -- pick-up --.

Column 9,
Line 44, delete “pickup” and insert -- pick-up --.

Column 10,
Line 49, delete “pickup” and insert -- pick-up --.
Line 55, after “cover,” delete “LIP”.

UNITED STATES PATENT AND TRADEMARK OFFICE

CERTIFICATE OF CORRECTION

PATENT NO. : 6,311,514 B1 
DATED : November 6, 2001
INVENTOR(S) : Jerry H. Chisnell It is certified that error appears in the above-identified patent and that said Letters Patent is hereby corrected as shown below:

Column 11,
Line 51, delete “pickup” and insert -- pick-up --.
Line 62, delete “pickup” and insert -- pick-up --.

Column 12,
Line 29, delete “matrixwalled” and insert -- matrix walled --.
Line 47, delete “pickup” and insert -- pick-up --.
Line 58, delete “pickup” and insert -- pick-up --.

Signed and Sealed this

Nineteenth Day of November, 2002

*Attest:*

*Attesting Officer*

JAMES E. ROGAN
*Director of the United States Patent and Trademark Office*